United States Patent [19]

Honkawa

[11] 3,934,872

[45] Jan. 27, 1976

[54] PRINTED SHEET GUIDE MECHANISM IN OFFSET PRINTING PRESS

[75] Inventor: Yoshinori Honkawa, Hiroshima, Japan

[73] Assignee: Ryobi, Ltd., Hiroshima, Japan

[22] Filed: Oct. 2, 1974

[21] Appl. No.: 511,367

[30] Foreign Application Priority Data

Oct. 3, 1973 Japan ..... 48-115298

[52] U.S. Cl. ..... 271/188; 271/161; 101/232

[51] Int. Cl.[2] ..... B65H 29/70

[58] Field of Search ..... 271/80, 161, 188, 209; 101/132, 142, 232

[56] References Cited

UNITED STATES PATENTS

| | | | |
|---|---|---|---|
| 197,477 | 11/1877 | Kneeland | 271/188 |
| 1,220,353 | 3/1917 | Lindbladh | 271/188 |
| 1,891,286 | 12/1932 | Miersch | 271/188 |
| 2,783,043 | 2/1957 | Tomlin | 271/188 |
| 2,796,259 | 6/1957 | Fawcett | 271/188 |
| 3,596,904 | 8/1971 | Nyberg | 271/80 |

*Primary Examiner*—Evon C. Blunk
*Assistant Examiner*—Robert Saifer

[57] ABSTRACT

The printed sheet guide mechanism in an offset printing press comprises a stay provided parallel to a delivery roller which is in frictional contact with the eject rollers to rotate therewith, and a pair of guide members each of which has a slanted or curved guide flap. Each of the guide members is secured to the stay so that they are adjustable in their lateral movement, and is also so adapted as to hold at its both edges the printed sheet delivered out passing between the eject rollers and delivery rollers. The guide flap provided in each guide member is designed to bend or curve both edges of the printed sheet to give stiffness thereto.

5 Claims, 3 Drawing Figures

PRINTED SHEET GUIDE MECHANISM IN OFFSET PRINTING PRESS

This invention relates to a printed sheet guide mechanism in an offset printing press.

In the offset printing presses in general, a delivery roller is provided on the sheet delivery side of the impression cylinder to guide the printed sheet onto the delivery board. However, according to these offset presses used heretofore, the printed sheet would be rolled up on an operating cylinder during delivery or would be delivered ununiformly to the delivery board. Such roll-up was bound to take place particularly when the sheet is thin and weak in body strength. This obliged interruption of the printing operation and necessitated troublesome treatments after the printing operation, resulting in reduced printing workability. They also involved the problem in maintenance and management of the machine.

In order to solve the above-said problems, it has been attempted to provide eject rollers designed to make frictional rotation with the delivery roller so as to give stiffness to each printed sheet to thereby prevent roll-up or non-uniformity of the sheets on the delivery board. According to these means, however, the portion of each sheet pressed by the eject rollers is restricted positionally in order to avoid soiling of the printed face, so that it was difficult to give the sheet stiffness strong enough to perfectly prevent roll-up of the sheet. Therefore, the troubles resulting from such roll-up of the sheets have been caused frequently particularly when the sheets used are thin.

The object of the present invention is to provide a printed sheet guide mechanism whereby each printed sheet delivered out after having been given certain stiffness by use of the eject rollers is given additional stiffness at a suitable selected position so as to perfectly prevent roll-up of the sheets while allowing orderly delivery thereof onto the delivery board.

The above-said and other objects and advantages of the present invention will become apparent from a consideration of the following detailed description of the invention taken in conjunction with the accompanying drawings, in which.

Figure 1:
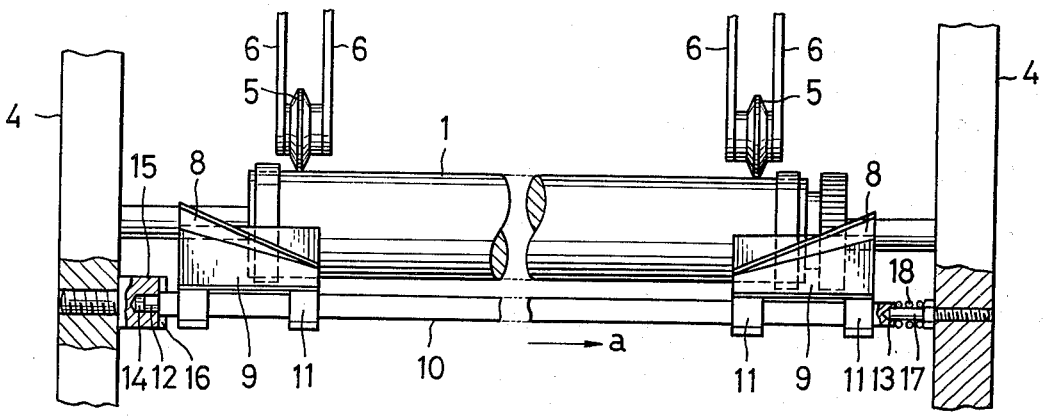
FIG. 1 is a front view of a printed sheet guide mechanism according to the present invention, with parts absent in the drawing.
Figure 2:
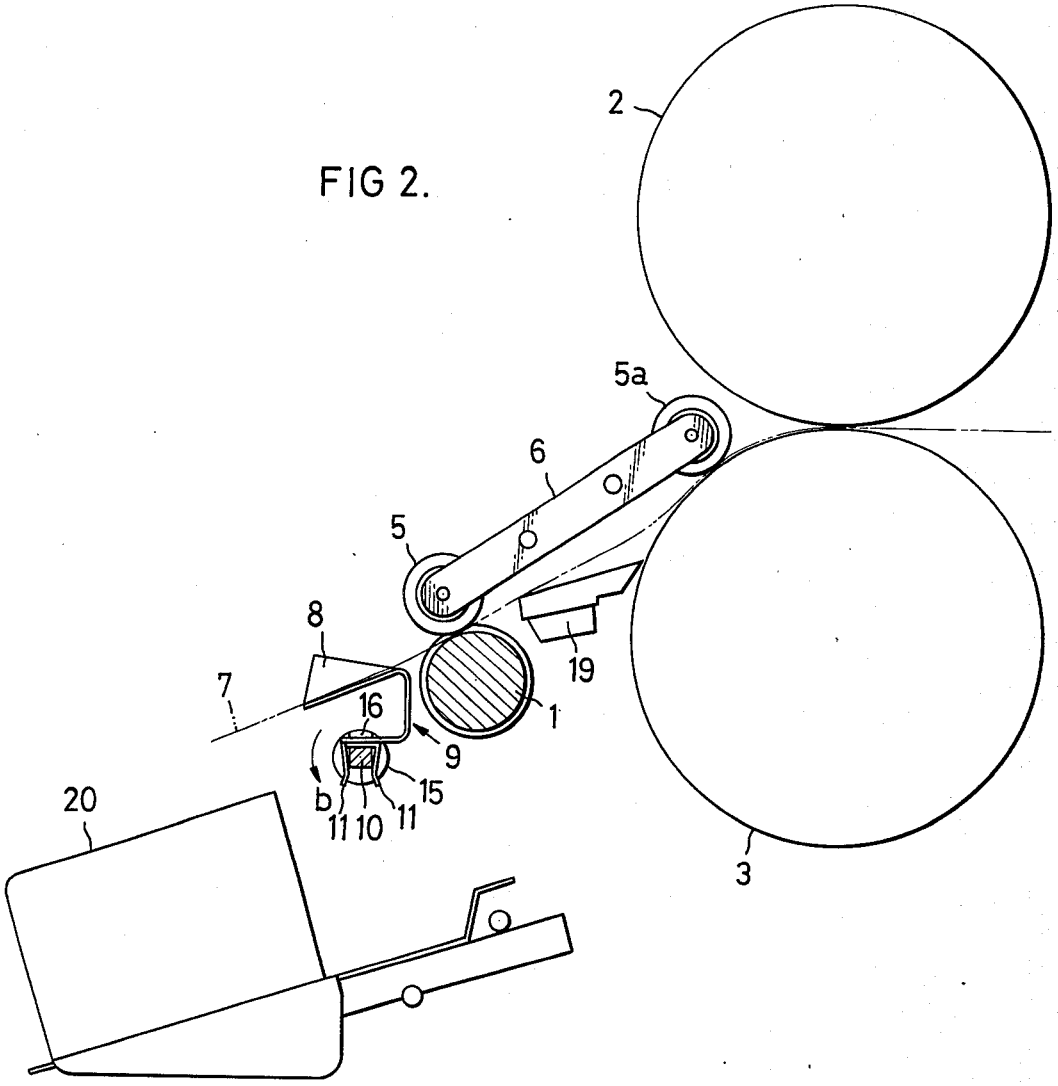
FIG. 2 is a side elevational view showing distinctly, with some exaggeration, the positional relation between the sheet guide mechanism of the present invention and the printing press adapted with the mechanism.

Referring first to FIGS. 1 and 2, it will be seen that a delivery roller 1 is mounted pivotally in the machine frame 4 and parallel to a rubber-blanketted cylinder 2 and an impression cylinder 3. This delivery roller is connected to a driving power source through a suitable transmission mechanism. Provided close to both ends of and in contact with the delivery roller 1 are the eject rollers 5 each of which is pivotally supported by the ends of support arms 6 such that each the eject roller 5 is freely adjustable in its lateral movement and able to make frictional rotation with the delivery roller. Pivotally supported at the other ends of the support arms 6 are similar eject rollers **5*a* which are arranged in contact with the impression cylinder 3 so as to make frictional rotation with the latter. Each printed sheet 7 travelling over the delivery roller 1 is given preliminary stiffness by the eject rollers 5 pressed against the delivery roller 1. Disposed between the impression cylinder 3 and delivery roller 1 is a paper stopper 19 adapted to prevent the sheet 7 from being rolled up onto the impression cylinder 3 and to guide the sheet 7 in between the delivery roller 1 and eject rollers 5**.

Figure 3:
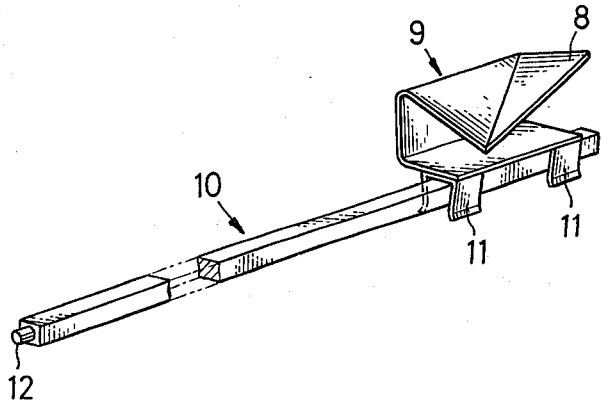
FIG. 3 is a perspective view of a guide member secured to a stay.

According to the present invention, a pair of guide members 9 each having a guide flap 8 are provided forwardly of the delivery roller 1 and eject rollers 5, that is to say, on the sheet delivery side of the delivery roller 1, to thereby give additional stiffness to each printed sheet 7 (see FIG. 2). A stay 10 having a polygonal cross-sectional shape is passed across the body frame members 4 and parallel to delivery roller 1 and eject rollers 5. As shown in FIG. 3, the guide members 9 having respectively on their back sides a pair of elastic holding plates 11 adapted to hold the stay 10 at its both sides are secured to the stay 10 such that they are adjustable in their lateral movement intermittently. At the upper end of each the guide member 9 is provided a guide flap 8 which is curved or slanted so that it can upwardly bend or curve each edge of the sheet along its travelling direction to thereby give stiffness to the sheet. The stay 10 is formed with a threaded portion 12 at its one end and a tapped hole 13 at its other end, as shown in FIG. 1. The threaded portion 12 is engaged into the corresponding internally threaded hole 14 of a bearing 15 which is threadedly secured to the body frame 4, and a recession 16 is formed at the inner end face of the bearing 15 to receive the corresponding end of the stay 10 to inhibit rotation thereof, thereby holding the guide members 9 at the fixed positions. A pin 17 threadedly secured at its one end into the frame 4 is fitted into the tapped hole 13 at the other end of the stay 10, and a compression spring 18 is disposed between the other end face of the stay and the pin or the body frame 4 to press the stay 10 in one direction. In this way, one end of the stay 10 is securely held in the recession 16 to fix the stay 10 and guide members 9 at the desired positions.

The printed sheet guide mechanism having the above-described arrangements operates as follows.

Each printed sheet 7 which has been printed by the rubber-coated cylinder 2 and delivered as shown in FIG. 2 is given stiffness at its parts involving no possibility of soiling the printed face, that is, at the edge portions of the sheet when passing under the eject rollers 5, and then further moves forward intermittently over the guide flaps 8 of the fixed guide members 9 so that the sheet is curved upwardly along its travelling direction, eliminating any possibility of the sheet to bend downwardly or to be folded by its own weight. Thus, the sheet won't be rolled up onto the impression cylinder but is delivered in order onto the delivery board 20. In case no paper guide is required as when using thick printing paper having high stiffness with little probability of suffering trouble from roll-up, the stay 10 is pulled in the direction of arrow *a* in FIG. 1 to free the stay end from the recession 16 and then is turned in the direction of arrow *b* in FIG. 2 to let the guide members 9 fall forwardly and then the stay end is fitted in the recession 16 to fix the stay in its inoperative position.

In the embodiment shown in FIG. 1, the guide members 9 are fixed at a position where they give stiffness to both edges of the printed sheet 7, but such position is not critical; it is possible to select other positions effective for preventing roll-up of the sheet. Since the guide members 9 are arranged to grip the stay 10 by the elastic gripping plates 11 provided in opposition thereto, lateral movement of the stay can be adjusted with case by simply moving the guide members laterally.

Thus, according to the printed sheet guide mechanism of the present invention, each printed sheet which has been delivered after having been given preliminary stiffness by combination of the delivery roller 1 and eject rollers 5 is further guided forwards by the curved or slanted guide flaps 8 formed integral with the respective guide members 9 fixed through the medium of the stay 10 and is again greatly curved at a more effective position and given additional stiffness, so that the printed sheet won't be rolled up onto the delivery roller but is delivered regularly onto the delivery board 20. The mechanism of the present invention, therefore, proves most effective for stabilizing delivery of the thin sheets of paper with low folding endurance. Each guide member 9 provided with a guide flap 8 can be adjusted in its position by lateral movement in accordance with the type and size of paper used, so as to give proper stiffness to the most effective position of each sheet of paper. In case the paper used is thick and stiff and no guide is required, the guide flaps can be placed aside with a simple operation to the position where they don't disturb paper delivery and other printing operations. The guide mechanism of the present invention is also simple in construction and hence low in manufacturing cost.

What is claimed is:

1. A printed sheet guide mechanism in an offset printing press comprising:

a delivery roller rotatably mounted in a machine frame and contacted rotatably with a pair of eject rollers;

a stay secured at its both ends to the frame and disposed parallel to said delivery roller; and, a pair of guide members each of which has formed integral therewith a slanted guide flap adapted to bend each edge of the printed sheet along its travelling direction to give stiffness to the sheet, said guide members being fixed to said stay so as to be adjustable in lateral movement thereof, and wherein each of said guide members is made from a plate-like member and includes a horizontal portion, a vertical portion erected from the rear end of said horizontal portion, a sloping portion slanting downwardly from the top end of said vertical portion at an inclination corresponding to the angle at which the printed sheets are delivered, and a guide flap raised up with a slant from the inner side of the front end to the outer side of the rear end of said sloping portion.

2. The printed sheet guide mechanism according to claim 1, wherein:

said frame includes a pair of upright spaced frame members; and said stay is polygonal in sectional shape and formed at its one end with a shaft hole in which fits a shaft secured to one of the frame members, the other end of said stay being fitted into a polygonal recession provided in the other frame member.

3. The printed sheet guide mechanism according to claim 2, wherein said other end of the stay is elastically pressed into the recession in said other frame member by a compression spring coiled around the shaft secured to said frame member, whereby said stay is held in position such that, if desired, it can be removed by pulling it against said elastic force applied thereto.

4. The printed sheet guide mechanism according to claim 1, wherein each said guide member is provided with a pair of elastic gripping plates extending downwardly from the horizontal portion, whereby the polygonal stay is securely gripped thereby to fix the guide member to the stay so that it is movable laterally thereof.

5. A printed sheet guide mechanism in an offset printing press having a delivery roller assembly and a pair of guide members each of which has formed integral therewith a slanted guide flap adapted to bend each edge of the printed sheet along its travelling direction to give stiffness to the sheet, said guide members being adjustably positionable along an axis parallel to the axis of said delivery roller, each of said guide members being made from a plate-like member and including:

a horizontal portion;

a vertical portion erected from the rear end of said horizontal portion;

a sloping portion slanting downwardly from the top end of said vertical portion at an inclination corresponding to the angle at which the printed sheets are delivered; and a guide flap raised up with a slant from the inner side of the front end to the outer side of the rear end of said sloping portion.

* * * * *